United States Patent [19]

Cavalli

[11] Patent Number: 4,601,615

[45] Date of Patent: Jul. 22, 1986

[54] ENVIRONMENTAL CUT-OFF FOR DEEP EXCAVATIONS

[75] Inventor: Nicholas J. Cavalli, Yonkers, N.Y.

[73] Assignee: FINIC, B.V., Rotterdam, Netherlands

[21] Appl. No.: 468,724

[22] Filed: Feb. 22, 1983

[51] Int. Cl.[4] ..... E02D 5/20

[52] U.S. Cl. ..... 405/267; 52/595; 52/742; 52/744

[58] Field of Search ..... 405/267, 274, 278, 279, 405/281; 52/588, 589, 593, 595, 742, 743, 744

[56] References Cited

U.S. PATENT DOCUMENTS

| | | | |
|---|---|---|---|
| 735,489 | 8/1903 | Friestedt | 405/281 |
| 912,020 | 2/1909 | Neilson | 405/281 |
| 3,001,333 | 9/1961 | Piana | 52/595 X |
| 3,796,054 | 3/1974 | Piccagli | 405/267 |
| 3,820,344 | 6/1974 | Caron et al. | 405/267 |
| 4,154,041 | 5/1979 | Namy | 52/573 |

FOREIGN PATENT DOCUMENTS

| | | | |
|---|---|---|---|
| 2252599 | 5/1973 | Fed. Rep. of Germany | 405/267 |
| 2944385 | 5/1981 | Fed. Rep. of Germany | 405/267 |
| 49424 | 4/1980 | Japan | 405/267 |

*Primary Examiner*—David H. Corbin

*Attorney, Agent, or Firm*—Jim Zegeer

[57] ABSTRACT

High density polyethylene sheets are installed in panel forms to form an impervious barrier to fluid flow particularly corrosive contaminates and pollutants. A slit is excavated in the earth under a bentonite slurry to the required depth. A relatively thick, high density polyethylene sheet is placed in the trench and connected to two high density polyethylene pipes or channel members, the width of which, in the direction transverse to the direction of the wall, is the width of the trench. The panel length typically will be 15 to 30 feet. Once the high density polyethylene panel is installed, the slurry is displaced on both sides by a backfill material that can be a soil-bentonite, cement-bentonite or concrete. A secondary panel section intermediate two previously formed primary panels is made using a secondary panel of high density polyethylene similarly constructed but using smaller diameter pipe or channel members than the primary panel pipes. This panel is then lifted and the two smaller pipes or channels lowered into the primary panel pipes or channels with the high density polyethylene panel extending between through two slots or openings in facing primary panel pipe or channel elements. A non-shrinking grout is then pumped into the pipe connection to form a tight joint.

14 Claims, 5 Drawing Figures

ENVIRONMENTAL CUT-OFF FOR DEEP EXCAVATIONS

BACKGROUND AND BRIEF DESCRIPTION OF THE INVENTION

The formation of underground impermeable barriers using slurry trench techniques has been widely developed in recent years and in a number of instances, attempts to utilize impervious plastic or rubber sheets to form impermeable barriers in such cut-off walls has been attempted. In Ranney U.S. Pat. No. 2,048,710, a pair of lining materials such as fabric or paper or other lining material which has been treated so that the lining material acts as a separator or divider between the earth material and the wall material after the wall material has been placed in the trench. In Zakiewicz U.S. Pat. No. 3,603,099, an intraground water proof baffle is disclosed in which the roll of flexible water proof plastic foil is displaced along the line of the excavation so that as the trench is cut, the foil is layed in a vertical plane behind the excavator and then the space between the foil and the sides thereof is filled with a wall forming material. In Piccagli U.S. Pat. No. 4,193,716 and Carron et al U.S. Pat. No. 3,759,044, plastic sheets are embedded in diaphram walls. These processes and structures are not amenable to the placement of such synthetic plastic materials in deep excavation using the slurry wall construction technique. In Ressi application Ser. No. 252,676, filed Apr. 9, 1981 and assigned to the assignee hereof, a plastic sheath or envelope is provided in which the wall forming material is in the sheath or envelope.

A pollution control barrier according to a preferred embodiment of the present invention comprises a narrow slot excavated in the earth using the bentonite slurry technique as disclosed in Veder U.S. Pat. No. 3,310,952, such that the earthen walls are impregnated with bentonite and a bentonite cake is formed on the surfaces thereof. A plastic sheet is inserted in the slot and, preferrably, is aligned with the center of the slot and a wall forming material fills the slot on both sides of the plastic sheet. An important feature in the present invention is in that the plastic sheeting is in panel sections as follows: a first series of the panel sections having vertical plastic primary tubes or channels bonded to the lateral ends, respectively, of the plastic sheet, each said plastic tube or channel having a diameter at least equal to the width of the slot in the earth with the ends of the plastic sheet fusingly bonded to one side, respectively, of each said tube in a fluid impervious manner. Each of the vertical plastic tubes or channels has a slit or elongated opening in the opposite side to which the plastic sheeting is bonded. A second series of panel sections, alternating with the first series of primary panel sections along the line of the wall are constituted by a further plastic sheeting with secondary pipe or channel members secured to the ends of the sheet, the secondary pipe or channel members having a diameter or size small enough to telescope within the first tubes with the plastic panel sheeting passing through the slits or elongated openings, respectively, in the primary tube or channel members and finally, a grouting means fills all of the voids in the tubes or channels displacing any bentonite that may have seeped therein. The grout is a non-shrink type and is pumped into the joint connection to form a tight joint. The resulting wall has chemical resistivity and lower permeability. In addition, it allows the synthetic material to be placed in deep excavations using slurry wall construction methods and the joints will allow for a continuous impervious wall system. It is simpler and easier to install in short panel sections. Different sections of the impervious wall can be tailored to have different properties. The cut-off made according to the present invention can be used for deep excavations (at least over 70 feet deep) and still be continuous.

BRIEF DESCRIPTION OF THE DRAWINGS

The above and other objects, advantages and features of the invention will become more readily apparent from the accompanying drawings in which:

Referring now to FIGS. 1, 2 and 3, the primary panel sections $P_1$, $P_2 \ldots P_N$ are formed in excavations which are carried out under a bentonite slurry to a depth D which is at least down to the level below which any expected pollutant may be found or expected to flow and typically is down to the water table and in panel lengths typically of 15 to 30 feet. A pair of high density polyethylene pipes or tubular channel members 10 and 11 having diameters equal to the width W of the trench section is connected by a high density polyethylene sheet 12 which, in this example, is about 100 mills thick, but which obviously can be of greater or lesser thicknesses and of any other plastic material having appropriate chamical and mechanical properties. The lateral ends 13 and 14 of high density polyethylene sheet 12 are bonded to the external surfaces of high density polyethylene pipes 10 and 11 in an impervious fluid type manner by electronic or chemical welding, fusion or joining and sealing all of which are conventional. Single high density polyethylene sheet 12 may be composed of several sheets which are fusingly joined or bonded at their edges to form the desired barrier but in the preferred embodiment, it is a single intregrally formed sheet so as to assure that there are no leaks in the sheet. Plastic sheet 12 is joined to pipes 10 and 11 at lateral edges 13 and 14 prior to insertion of same into the excavated trench.

Once the panel section is set, the bentonite slurry on each side of sheet 12 is displaced by a backfill which can be a mixture of soil-bentonite, cement-bentonite or concrete, etc. As shown in connection with the filling of secondary panel section S1, the backfill is accomplished by the tremie pipe technique whereby the backfill material is hydraulically introduced into the excavation on both sides of the sheet by hollow steel tubes 16–17 which are gradually raised so that their lower ends remains within the heaps 18 of backfill material on both sides of sheet 12 so that there is no differential backfill loading applied to the sheet. The lower ends of the tubes remain within the backfill heap 20 and the slowing rising heap of backfill material rises upwardly and the amount of bentonite which is in the excavation thereabove is displaced and removed for storage for use in other excavating operations. The operation is terminated when the backfill material reaches the surface of the ground. A clay or concrete cap or cover may be applied at the surface of the wall.

In accordance with the technique disclosed in this preferred embodiment, the length of the secondary panel S1 is omitted and another primary panel P2 is installed following the procedure described above.

The pipes 10 and 11 have wall thicknesses of ¾ to 1 inch. They may be cast or extruded, with or without reinforcement fibers, etc.

It will be appreciated that the primary excavations can be made using any conventional slurry trench excavation technique such as a clam shell, rotary drill bits and even backhoed in the shallower depth walls. Moreover, the trench excavations can be made in panel sections or as a continuous length trench in which the excavation is formed and maintained in a bentonite slurry and first at least two primary panel sections P1 and P2 are installed and backfilled to form stable structures and then the intervening secondary panel S1 is installed between two primary panel elements P1, P2.

Figure 2:
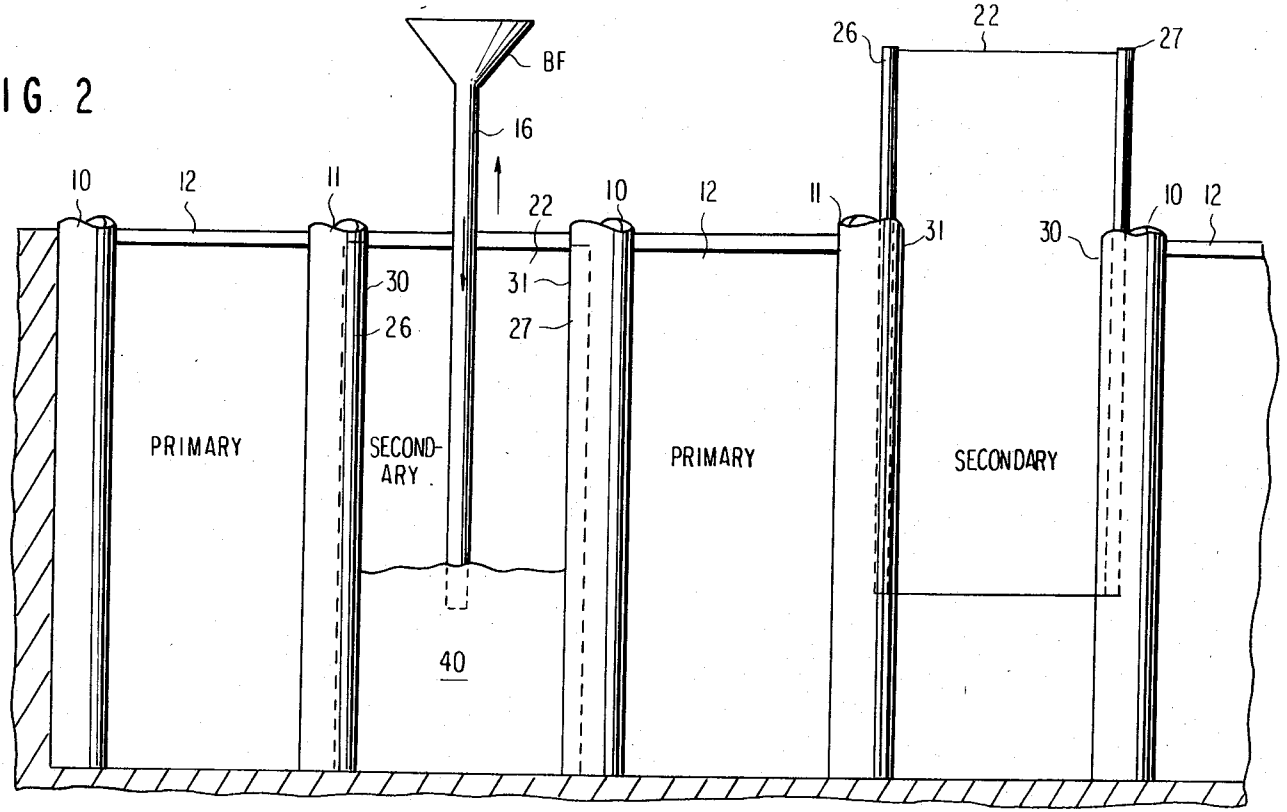
FIG. 2 is an elevational view of the construction shown in FIG. 1.

In installing the secondary panel element S1, a secondary panel of high density polyethylene sheet 22 has its lateral ends 23 and 24 secured to smaller diameter high density polyethylene rods, pipes, tubes 26 and 27, respectively, the facing surfaces of the larger diameter polyethylene pipes 10 and 11 have full length slits or slots in the surfaces, thereof facing the excavation for the secondary panel element S1. These slits or slots 30, 31 are made at least large enough so that they can easily accomodate the thickness of the high density polyethylene sheets 22, the edges of the slits or slots being smooth and rounded without sharp edges so as to avoid damaging the plastic sheet. This panel section is then lifted and the two smaller diameter pipes 26, 27 are lowered or telescoped into the larger diameter pipes 10 and 11 as is illustrated in secondary panel section S2. The panel is lowered into the trench section and the bentonite slurry contained therein to its final depth and then the backfill material is inserted as described above and is illustrated in connection with tremie pipes 16 and 17. While in FIG. 2 there is illustrated a funnel shaped device BF for receiving the backfill material, it will be appreciated that this is purely diagrammatic as illustrating a means for supplying backfill materials for filling the trench sections on each side of the polyethylene sheets at substantially equal rates so as to avoid undue loading and distortion and stretchings of the sheet.

Figure 3:
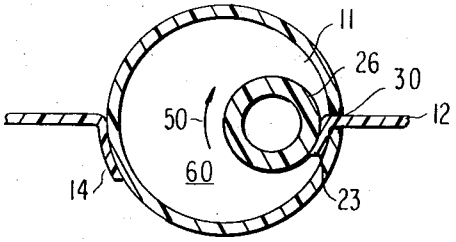
FIG. 3 is an enlarged view of a joint according to the invention.

As shown in FIG. 3, the thicknesses of the two pipes need not be the same nor need they even be of the same material. In order to remove any slack or lack of any tautness in the sheet 12, the smaller diameter pipe may be given a rotary twist or turn as indicated by the arrow 50 and the pipe 26 need not be hollow but can be a solid rod or pipe. Moreover, as will appear more fully hereafter, it need not be circular or round.

A non-shrinking grout 60 is then pumped into the pipe connections or space between the outer surfaces of the smaller diameter pipe 26 and the inner surfaces of the larger diameter pipe 11 so as to form a tight joint.

Figure 1:
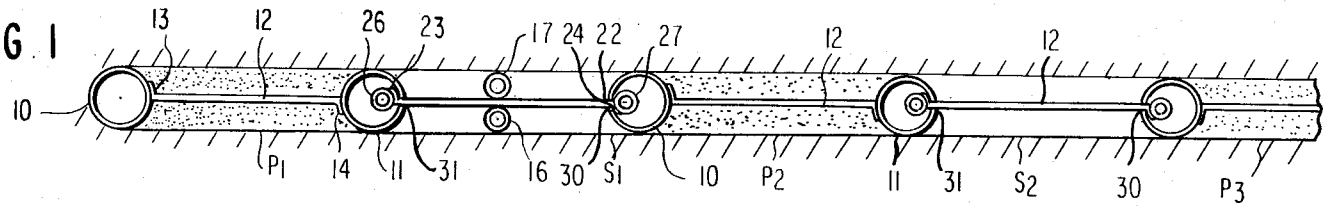
FIG. 1 is a top plan view illustrating in somewhat diagrammatical manner construction of a deep environmental wall according to the invention.
Figure 4:
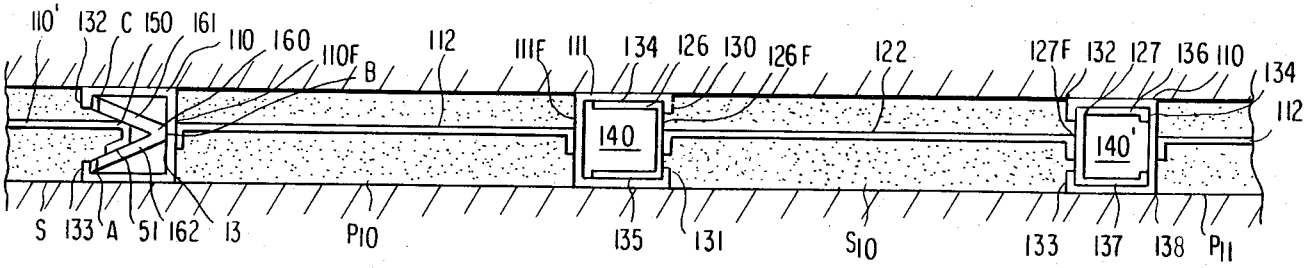
FIG. 4 is a top plan view of a modification of the invention and, FIG. 5 is a top plan view of a further modification of the invention.

In FIG. 4, instead of round pipe sections, rectangular pipe sections are utilized. In the primary panel section P10 a pair of generally square pipe or channel sections 110 of impermeable high density polyethylene or other plastic material having high chemical resistivity can be utilized. In this case, the high density polyethylene sheet 112 is sealingly bonded or joined to the facing flat surfaces 110F and 111F throughout the entire length of the pipe or channel sections 110 and 111. Backfilling is carried out with the dual tremie pipe system as shown in connection with FIGS. 1 and 2 to form the primary panel elements P10, P11. In secondary panel section S10, a pair of oppositely facing channel members 126 and 127 has the flat facing sections 126F and 127F bridging the gap between the legs 130 and 131 of channel section 111 and 132 and 133 of channel section 110. In this case, the legs 134, 135 of the smaller channel member 126 are sprung outwardly slightly so that when section 126 is telescoped within the confines of pipe or channel member 111, legs 134, 135 made a good solid contact with the internal surfaces of channel 111 to thereby provide a better seal and long paths to any pollutant. Again, the internal space 140 is filled with a non-shrink grout which is pumped into the connection to form a tight joint. The high density polyethylene sheet 122 is made taut and spans the full length of the panel section to form the impervious barrier. As shown, the ends of legs 136 and 137 of channel member 127 are turned inwardly so that the length of channel legs 136 and 137 is just slightly greater than the internal dimension of this space so that the legs 132 and 133 are sprung slightly outwardly so as to maintain a good tight joint. In this case, a slightly greater area of contact between the plastic pipes is utilized to form a tighter seal. To the left of element 4, the end of sheet 110' is sealed at two places 150 and 151 to a V-shaped channel member 160. Channel member 160 has a pair of legs 161, 162 which press against the inside surface 163 of channel member 110 and against the inside back surfaces of short legs 132, 133 of channel member 110. Again, any open space is filled with a non-shrink grout. It will be appreciated that various instrumentations may be installed in the joints to detect any imperfections in the joint. Instead of a grout, any bentonite in the joints may be removed after the wall forming material has been inserted and then the open spaces are filled with a chemical setting agent such as various resins and the like to bond with the surfaces of the two pipe or sections forming the joint.

Figure 5:
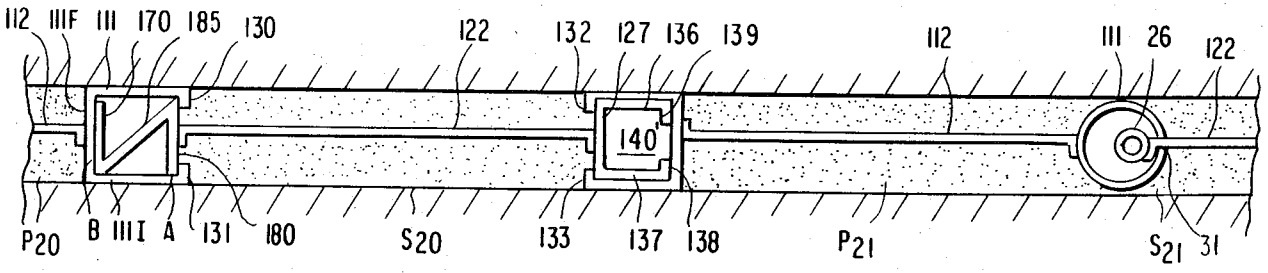

In FIG. 5, the left most joint incorporates a Z-shaped channel member which has a pair of legs 170, 180 which are transverse or normal to the line of the wall and a connecting leg 185 which urges the legs 170 and 180 into contact with their opposing surface legs 130, 131 and the inside surface 111 of channel member 111. As in the structure shown at the joint to the left of FIG. 4, there are three elongated contact points forming three separate and distinct barriers A, B, C to the flow of pollutant through the joint.

As shown in FIGS. 4 and 5, while it is preferrable to utilize the same type joint throughout the line of the wall, this is not necessary and the different type of joints may be intermixed as to take advantage of the different type constructions. While the walls have been shown as being straight walls, it will be appreciated that they may be curved and closed on itself to make an endless wall such as for an impoundment pond enclosure of the like. In other words, with reference to FIG. 4, when the panel element 126, 136, 122 is inserted and the backfilling material placed, elements 110 and 111 may be the facing ends of one wall structure. It will be appreciated that instead of a single sheet being secured to the channel or pipe members, double sheets folded and/or secured at the bottom may be utilized in the manner disclosed in Ressi application Ser. No. 252,676, filed Apr.

9, 1981, entitled "Method and Apparatus for Constructing a Novel Underground Impervious Barrier". As noted earlier, the walls can go to a depth of up to 300 feet. In the forming of the bonding of the polyethylene sheet to the rods, channel members, etc. it is good practice to first sand or roughen the surfaces and pre-heat same to about 120° F. A bead of at least about ½" or more of material provides a good impervious joint. As noted above, while it is desirable to use the same materials in forming the sheet as well as the pipe and channel members, this is not necessary. The pipe can be reinforced by fiber material such as fiber glass and the like but this is not necessary. The joint can be formed by chemical fusion or the like.

With respect to the pipes themselves, the ratio of diameter of the larger pipe to the smaller pipe such as to make it easier to grout the larger space between the two. For example, for a 3 foot wall, the large pipe will be about 3 foot in diameter while the smaller pipe would be about 12 inches or 1 foot in diameter.

While there has been shown and described the preferred embodiment of the invention, it will be understood that this disclosure is for the purpose of illustration and various omissions and changes in shape, proportion, and arrangement of parts as well as the substitution of equivalent elements for the arrangement shown and described may be made without departing from the spirit and scope of the invention as set forth in the appended claims.

What is claimed is:

1. In a method of making a liquid impervious barrier in the earth wherein a narrow trench is formed by slurry trench excavation and a plastic sheet is embedded in the backfill material filling said narrow trench, the improvement in the embedment of said plastic sheet in said backfill comprising, (a) dividing said plastic sheet into primary and secondary panel sections, (b) sealingly securing the lateral ends of said primary panel sections of plastic sheet to facing surfaces of pairs of spaced apart primary plastic tubular members, said pairs of spaced apart primary plastic tubular members having slots in surfaces opposite the surfaces to which said lateral ends have been sealingly secured and a dimension in a direction transverse to the length of said narrow trench at least equal to the width of said narrow trench to form primary panel elements, (c) sealingly securing the lateral ends of said secondary panel sections of plastic sheet to the facing surfaces of a pair of secondary rigid plastic members, to form a secondary panel elements, (d) inserting at least a pair of said primary panel elements as formed in step (b) into the slurry filled trench in spaced apart relation with the slots in said primary tubular members of said pair of primary panel sections facing each other, (e) displacing the slurry from said narrow trench between each said pair of spaced apart primary tubular members with a backfill material, said spaced apart tubular members serving as end stops for the backfill materials, (f) inserting one of said secondary panel elements between said inserted pair of primary panel elements with said secondary tubular member telescoping within the space bounded by said primary tubular members, said plastic panel section passing through said slots, respectively, and (g) sealingly filling the remaining space between said primary plastic tubular members and secondary plastic rigid plastic members and bounded by said primary tubular members.

2. The method defined in claim 1 wherein step (h) includes filling said space with a non-shrink grout.

3. The method defined in claim 1 wherein step (g) includes placing a pair of pipes on each side of said plastic sheet and backfilling the space from the bottom of said slurry trench to the top whereby the trench portions at each side of said plastic sheet is backfilled at substantially the same rate.

4. The method defined in claim 3 wherein step (h) includes filling said space with a non-shrink grout.

5. The method defined in claim 1 wherein said plastic sheet and said plastic tubular members are high density polyethylene and the seal is a fused seal, and the depth of said trench is up to 300 feet.

6. The method defined in claim 1 wherein said backfill material is inserted in said narrow trench portion between said primary tubular members for at least a pair of consecutive primary panel sections prior to insertion of the plastic sheet and backfill for an intervening secondary panel section.

7. The method defined in claim 1 including the step of removing any slack or lack of tautness in said plastic panel sections.

8. The method defined in claim 7 wherein the removal of any slack or lack of tautness is achieved by rotating one of said secondary rigid plastic members.

9. In an underground fluid impervious barrier wherein a narrow trench in the earth formed by slurry trench excavation has a plastic sheet embedded in backfill material filling said trench, the improvement in said plastic sheet comprising, A. at least a pair of primary wall panel elements, each one of said pair of primary wall panel elements comprising, (a) a pair of spaced apart primary tubular channel members having facing surfaces and oppositely facing surfaces, respectively, and a dimension transverse to the direction of said slurry trench excavation which is substantially equal to the width of said slurry trench excavation, (b) a plastic sheet spanning the space between said tubular channel members and having lateral ends which are sealingly joined to said facing surfaces on said spaced apart tubular members, respectively, (c) means forming a slot in each of said oppositely facing surfaces or primary tubular channel members of said pair of primary elements and, B. a secondary wall panel element in the trench space between said pair of primary wall panel elements, said secondary wall panel element comprising:

(d) a pair of spaced apart rigid secondary members larger in width than said slot and smaller than any internal dimension of said primary tubular members telescoped in said primary tubular channel members, (e) a plastic sheet having vertical lateral ends and means sealingly joining said vertical lateral ends to respective ones of said rigid secondary members and, C. means sealingly filling the space between the telescoped primary and secondary tubular members.

10. The underground fluid impervious barrier defined in claim 9 wherein said primary tubular channel members are made of a high density polyethylene and said secondary rigid members are made of a high density polyethylene and said lateral ends of said plastic sheets are fusingly bonded to said facing surfaces of said tubular channel members and said secondary rigid plastic members, respectively.

11. In an underground pollution control barrier comprising a narrow slot in the earth formed by slurry trench excavation, a backfill material filling said narrow slot and flexible plastic sheet barrier means embedded in said backfill, the improvement comprising, a plurality of the primary flexible plastic sheets and rigid plastic channel members and, a plurality of secondary flexible plastic sheets and rigid plastic secondary members, constructed as as follows:

a pair of vertical spaced apart rigid plastic channel members having mutually facing first surfaces and oppositely facing second surfaces, a primary plastic sheet spanning the space between said first surfaces, said primary plastic sheet having lateral ends which are sealingly joined to said first surfaces, means forming a slot in each said oppositely facing surfaces, first and second spaced apart vertical rigid plastic secondary members, said first and second rigid plastic members having mutually facing third and fourth surfaces, respectively, a secondary plastic sheet spanning the space between said mutually facing third and fourth surfaces and having lateral ends which are sealingly joined-to said facing third and fourth surfaces, respectively, each said rigid plastic secondary member being of a size as to telescopically receive in one of the first named pair of spaced apart channel members with said second flexible plastic sheet passing through said means forming a slot.

12. Apparatus for constructing an underground fluid barrier in a slot excavated in the earth, as defined in claim 11 wherein said primary plastic sheet spanning the space between said first surfaces is flexible.

13. Apparatus for constructing an underground fluid barrier as defined in claim 12 wherein said secondary plastic sheet spanning the space between said mutually facing third and fourth surfaces is flexible.

14. In an underground pollution control barrier comprising a narrow slot in the earth having earthen walls, said earthen walls being impregnated with bentonite and having a bentonite cake formed on the surfaces thereof, a plastic sheet in said slot and a wall forming material filling said slot about said plastic sheet, the improvement wherein said plastic sheet is in panel sections, a first series of said panel sections having vertical plastic tubes bonded to the ends, respectively, of said plastic sheet, each said plastic tube having a diameter at least equal to the width of the slot in the earth, with the ends of said plastic sheet fusingly bonded to one side, respectively, of each said tube in a fluid impervious manner, each said vertical plastic tube having a slit opposite the side to which said plastic sheet is bonded, a second series of panel sections alternating with said first series of panel sections along the line of said wall, said second series of panel sections being constituted by a plastic sheeting with rod members secured to the ends of said sheet, said rod member having a diameter or size small enough to telescope within said first tubes with the plastic paneled sheeting passing through said slits, respectively, and grouting means filling all of the voids in said tubes.

* * * * *